United States Patent [19]

Hasegawa

[11] Patent Number: 4,481,929

[45] Date of Patent: Nov. 13, 1984

[54] METHOD AND DEVICE FOR ATMOSPHERIC PRESSURE-DEPENDENT CORRECTION OF AIR/FUEL RATIO FOR INTERNAL COMBUSTION ENGINES

[75] Inventor: Shumpei Hasegawa, Niiza, Japan

[73] Assignee: Honda Motor Co., Ltd., Tokyo, Japan

[21] Appl. No.: 424,404

[22] Filed: Sep. 27, 1982

[30] Foreign Application Priority Data

Nov. 12, 1981 [JP] Japan ..... 56-181486

[51] Int. Cl.[3] ..... F02B 3/00

[52] U.S. Cl. ..... 123/494; 123/440; 123/489; 123/488

[58] Field of Search ..... 123/494, 488, 491, 492, 123/440, 489, 478

[56] References Cited

U.S. PATENT DOCUMENTS

| | | | |
|---|---|---|---|
| 3,651,791 | 3/1972 | Kobayashi | 123/494 |
| 4,131,088 | 12/1978 | Reddy | 123/494 |
| 4,376,431 | 3/1983 | Yokooku | 123/492 |
| 4,411,232 | 10/1983 | Atago | 123/440 |

*Primary Examiner*—Ronald B. Cox

*Attorney, Agent, or Firm*—Arthur L. Lessler

[57] ABSTRACT

A method comprising correcting the air/fuel ratio of a mixture being supplied to an internal combustion engine, by the use of a correction coefficient determined as a function of detected values of atmospheric absolute pressure and intake pipe absolute pressure. A device is also provided, which includes means for arithmetically calculating the correction coefficient as a function of outputs of sensors for sensing the two kinds of absolute pressure or means storing predetermined values of the correction coefficient for selective reading as a function of the sensor outputs, and means for correcting the valve opening period of a fuel injection valve by the calculated or read coefficient value.

7 Claims, 11 Drawing Figures

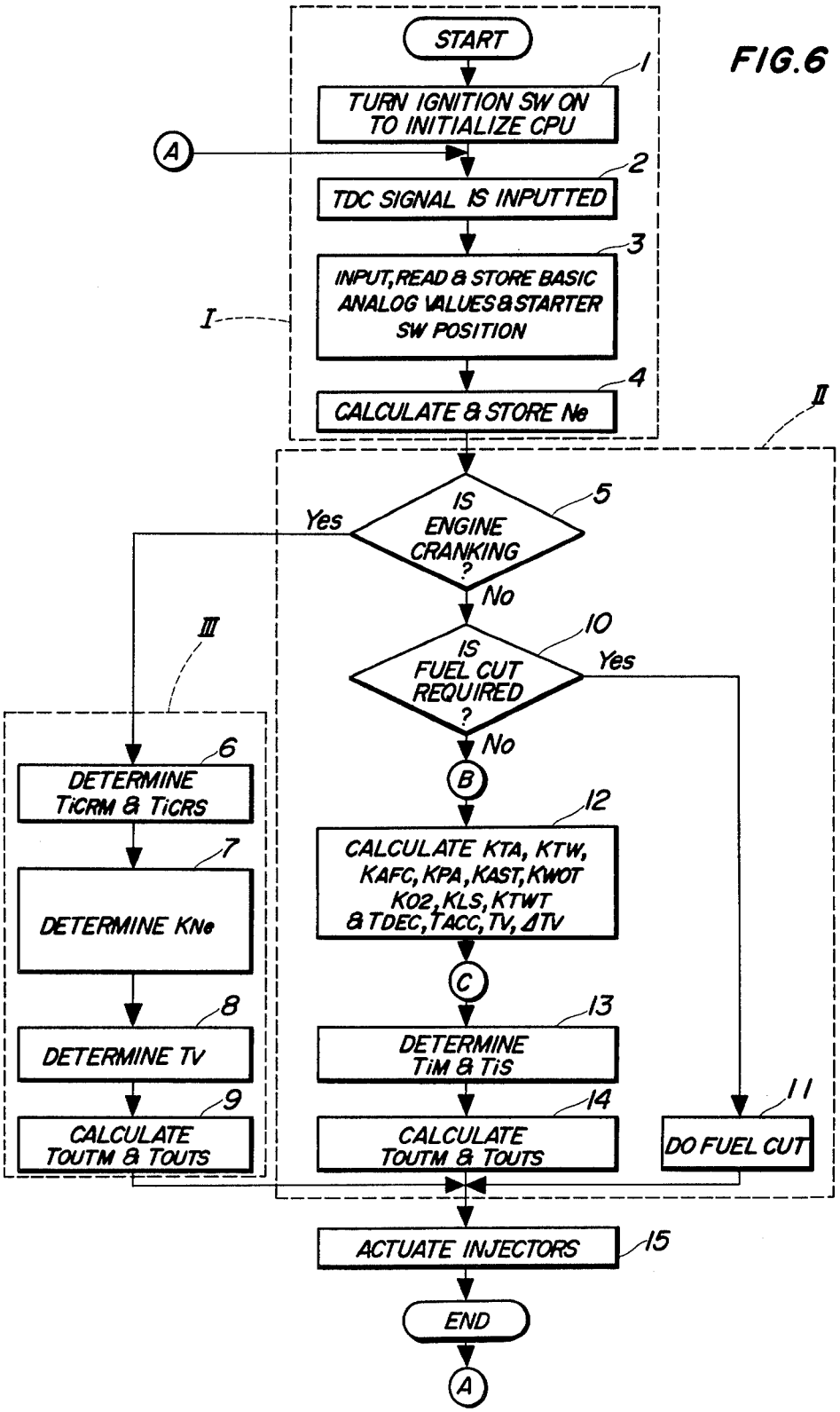
FIG.6
START
TURN IGNITION SW ON TO INITIALIZE CPU
TDC SIGNAL IS INPUTTED
INPUT, READ & STORE BASIC ANALOG VALUES & STARTER SW POSITION
CALCULATE & STORE Ne
IS ENGINE CRANKING ?
Yes
No
IS FUEL CUT REQUIRED ?
Yes
No
DETERMINE TiCRM & TiCRS
DETERMINE KNe
DETERMINE TV
CALCULATE TOUTM & TOUTS
CALCULATE KTA, KTW, KAFC, KPA, KAST, KWOT KO2, KLS, KTWT & TDEC, TACC, TV, ΔTV
DETERMINE TiM & TiS
CALCULATE TOUTM & TOUTS
DO FUEL CUT
ACTUATE INJECTORS
END
A
B
C
I
II
III
1
2
3
4
5
6
7
8
9
10
11
12
13
14
15

$K_{PA}$ VALUE
$K_{PA}$ VAL. REGISTER
$C_3/D_3$
$A_7$ REGISTER
$A_8$ REGISTER
$M_1-N_1$
$M_2-N_2$
$A_5$ REGISTER
$A_6$ REGISTER
DATE=1.0 MEMORY
$A_1 \times B_1$
$A_2 \times B_2$
$A_3$ REGISTER
$A_4$ REGISTER
1/ε VAL. MEMORY
$X_1\sqrt{Y_1}$
$X_2\sqrt{Y_2}$
$A_1$ REGISTER
$A_2$ REGISTER
K VAL. MEMORY
$C_1/D_1$
$C_2/D_2$
$P_B$ VAL. REGISTER
$P_A$ VAL. REGISTER
$P_{AO}$ VAL. MEMORY
cp0
cp1
cp2
cp3
cp4
cp5
cp6
cp7
cp8
cp9

| $P_A$ \ $P_B$ | $P_{B9}$ | $P_{B10}$ | ------ | $P_{Bj}$ | ------ | $P_{B16}$ |
|---|---|---|---|---|---|---|
| $P_{A1}$ | $K_{PA1 \cdot 9}$ | $K_{PA1 \cdot 10}$ | | | | |
| $P_{A2}$ | $K_{PA2 \cdot 9}$ | $K_{PA2 \cdot 10}$ | | | | |
| ⋮ | | | | | | |
| $P_{Ai}$ | | | | $K_{PAij}$ | | |
| ⋮ | | | | | | |
| $P_{A8}$ | | | | | | $K_{PA8 \cdot 16}$ |

METHOD AND DEVICE FOR ATMOSPHERIC PRESSURE-DEPENDENT CORRECTION OF AIR/FUEL RATIO FOR INTERNAL COMBUSTION ENGINES

BACKGROUND OF THE INVENTION

This invention relates to atmospheric pressure-dependent correction of the air/fuel ratio of a mixture being supplied to an internal combustion engine, and a device for practicing the same method.

A fuel supply control system adapted for use with an internal combustion engine, particularly a gasoline engine has been proposed e.g. by U.S. Pat. No. 3,483,851, which is adapted to determine the valve opening period of a fuel injection device for control of the fuel injection quantity, i.e. the air/fuel ratio of an air/fuel mixture being supplied to the engine, by first determining a basic value of the above valve opening period as a function of engine rpm and intake pipe absolute pressure and then adding to and/or multiplying same by constants and/or coefficients being functions of engine rpm, intake pipe absolute pressure, engine temperature, throttle valve opening, exhaust gas ingredient concentration (oxygen concentration), etc., by electronic computing means.

On the other hand, during operation of an engine at a high altitude, etc., it is generally carried out to correct the fuel supply quantity for the engine, in response to changes in the atmospheric pressure, so as to obtain an optimum air/fuel ratio best suited for the atmospheric pressure, for improvements in the fuel consumption, emission characteristics and driveability of the engine.

For instance, in a fuel supply control system adapted for correction of the basic valve opening period of a fuel injection valve by means of a correction coefficient as mentioned above, an atmospheric pressure-dependent correction coefficient is provided as one of the aforementioned correction coefficients, for correction of the air/fuel ratio of the mixture.

However, according to such conventional atmospheric pressure-dependent correction of the air/fuel ratio which is determined by intake pipe absolute pressure as noted above, the air/fuel ratio is corrected in dependence upon the atmospheric pressure alone. That is, the correction amount is not based upon the actual operating condition of the engine per se, making it difficult to perform the air/fuel ratio correction in a perfect manner.

OBJECT AND SUMMARY OF THE INVENTION

It is the object of the invention to provide a method and a device for atmospheric pressure-dependent air/fuel ratio correction, which is adapted to correct the air/fuel ratio of a mixture being supplied to an internal combustion engine, in dependence upon not only atmospheric pressure but also intake pipe absolute pressure, so as to always control the air/fuel ratio to an optimum value irrespective of changes in the atmospheric pressure, to thereby improve the fuel consumption, emission characteristics and driveability of the engine.

The prevent invention is based upon the recognition that the quantity of air sucked into the engine cylinders is variable as a function of intake pipe absolute pressure as well as atmospheric pressure.

The invention provides an air/fuel ratio correcting method which comprises detecting absolute pressure of the atmosphere encompassing an internal combustion engine and also the absolute pressure in an intake pipe of the engine at a location downstream of a throttle valve in the same pipe, determining the value of a correction coefficient as a function of the detected absolute pressure values, and correcting the air/fuel ratio of an air/fuel mixture being supplied to the engine, which has been determined as a function of the operating condition of the engine, by an amount corresponding to the correction coefficient value determined above.

Further, the invention provides an air/fuel ratio correcting device which comprises a first pressure sensor for detecting the absolute pressure of the encompassing atmosphere, a second pressure sensor for detecting the absolute pressure in the intake pipe, means for arithmetically calculating the value of the correction coefficient as a function of outputs of the first and second pressure sensors, and means for correcting the valve opening period of an electromagnetically operated fuel injection valve, which has been determined as a function of the operating condition of the engine, by an amount corresponding to the correction coefficient value calculated above.

Alternatively of the above arithmetically calculating means, the air/fuel ratio correcting device according to the invention may include means storing a plurality of predetermined values of the correction coefficient which are given as a function of the absolute pressure of the encompassing atmosphere and the absolute pressure in the intake pipe, and means responsive to outputs of the first and second pressure sensors for selectively reading a corresponding one of the predetermined coefficient values from the above storage means.

The above and other objects, features and advantages of the invention will be more apparent from the ensuing detailed description taken in connection will the accompanying drawings.

BRIEF DESCRIPTION OF THE DRAWINGS

FIG. 6 is a flow chart showing a main program for control of the valve opening periods TOUTM and TOUTS;

DETAILED DESCRIPTION

The present invention will now be described in detail with reference to the drawings.

Figure 1:
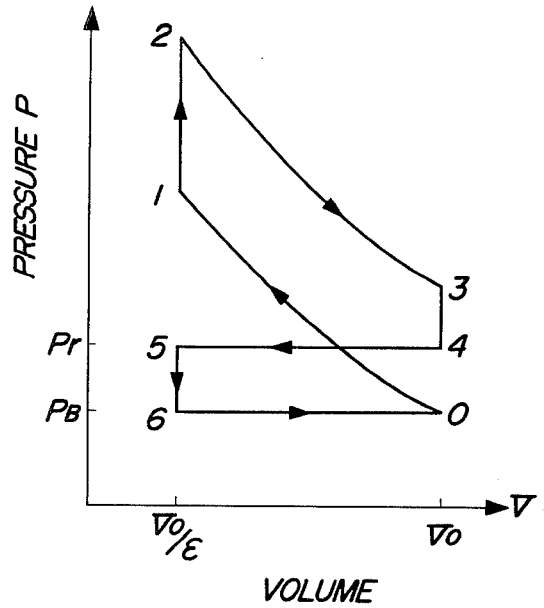
FIG. 1 is a pressure volume diagram of an Otto cycle engine.

FIG. 1 is a pressure volume diagram of an Otto cycle engine. 0→1 designates an adiabatic compression step, 1→2 an isochoric combustion step, 2→3 an adiabatic expansion step, and 3→4→5 an exhaust step, respectively. According to the diagram, when the exhaust valve is closed and simultaneously the intake valve is opened at state point 5, the pressure in the engine cylinder instantaneously drops from a value corresponding to exhaust pipe pressure Pr to a value corresponding to intake pipe pressure PB (step 5→6). In the diagram, 6→0 designates a suction step where the piston is moved from its top dead center to its bottom dead center.

It will now be explained how the suction gas amount Ga is determined during the step 5→6→0 where fresh air is sucked into the engine cylinder. In the explanation, let it be assumed that first, during the step 5→6 the residual gas in the engine cylinder is adiabatically expanded back into the intake pipe, while simultaneously reducing its own pressure from a value corresponding to pressure Pr to a value corresponding to pressure PB, and during the following step 6→0, the flowing-back residual gas and fresh air are sucked into the cylinder, while simultaneously exchanging heat with each other. Further, the heat exchange between the cylinder wall and the intake pipe wall, and the residual gas and fresh air is not taken into account in the assumption. Let it be also assumed as a second assumption that the residual gas and fresh air behave as ideal fluid and assume identical values with each other with respect to gas constant Ra, specific heat at constant pressure Cp, specific heat at constant volume Cv, and ratio of specific heat $\kappa$.

Figure 2:
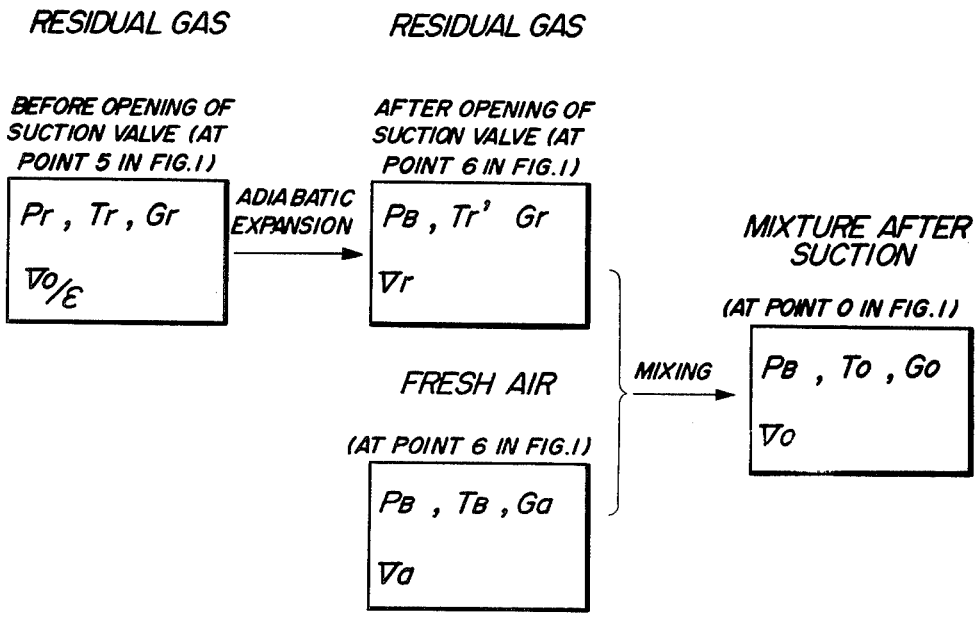
FIG. 2 is a view illustrating quantities of state of residual exhaust gas, fresh air, and a mixture thereof available, respectively, at state points 5, 6 and 0 in FIG. 1.

FIG. 2 shows the quantities of state of the residual gas, the fresh air and a mixture thereof, respectively, at state points 5, 6 and 0. The relationships between these quantities of state can be represented by the following equations. Symbols used in the equations are interpreted as follows:

P=pressure (Kg/cm$^2$abs.),
T=temperature (°K.),
G=quantity of air (Kg),
V=volume (m$^3$),
$\epsilon$=compression ratio of the engine,
$\kappa$=ratio of specific heat of air,
C=Vo/Ro, which is constant,
r,r'=as of residual gas,
B=as in the intake pipe,
a=as of fresh air, and
o=as at state point 0 in FIG. 1

According to the above second assumption that all the gases have the same value Cv and to the principle of conservation of energy, $$Go \cdot Cv \cdot To = Gr \cdot Cv \cdot Tr' + Ga \cdot Cv \cdot TB \quad (1)$$

According to the equation of adiabatic change, $$Tr' = Tr\,(PB/Pr)^{(\kappa-1)/\kappa} \quad (2)$$

$$Vr = (Vo/\epsilon) \times (Pr/PB)^{1/\kappa} \quad (3)$$

According to the equation of state, $$Pr \cdot Vo/\epsilon = Gr \cdot Ra \cdot Tr \quad (4)$$

$$PB \cdot Vr = Gr \cdot Ra \cdot Tr' \quad (5)$$

$$PB \cdot Va = Ga \cdot Ra \cdot TB \quad (6)$$

$$PB \cdot Vo = Go \cdot Ra \cdot To \quad (7)$$

From the equations (1), (5) and (6), $$PB(Vr + Va) = Ra \cdot Go \cdot To \quad (8)$$

If the equation (7) is substituted into the equation (8), $$Vr + Va = Vo \quad (9)$$

The equation (9) shows that the mixture does not change in volume so long as its own pressure is constant.

If the equations (3) and (6) are applied to the equation (9), $$Ga = C \cdot PB/TB\,\{1 - (1/\epsilon)(Pr/PB)^{1/\kappa}\} \quad (10)$$

The equation (10) forms the basic principle of the present invention, showing that the quantity of suction air Ga is given as a function of intake pipe pressure PB, intake pipe temperature TB, and exhaust pipe pressure Pr.

In the event that there occures a change in the back pressure or exhaust pipe pressure Pr at the step 3-4-5 in FIG. 1, in order to control the actual air/fuel ratio Ga/Gf (Gf=fuel quantity) to an air/fuel ratio Gao/Gfo at standard atmospheric pressure, that is, in order to satisfy the following equation:

$$Ga/Gf = Gas/Gfo, \quad (11)$$

a quantity of fuel has to be supplied to the engine, which is determined by the following equation:

$$Gf = Gfo \times Ga/Gao = Gfo \times \frac{\{1 - 1/\epsilon(Pr/PB)^{1/\kappa}\}}{\{1 - 1/\epsilon(Pro/PB)^{1/\kappa}\}} \quad (12)$$

provided with TB remains constant. In an internal combustion engine which does not include an element requiring high exhaust pressure, such as a turbocharger, the difference between the pressure Pr and the pressure PA is ignorably small, as compared with the difference between the pressure Pr and the intake pipe pressure PB. Therefore, from the equation (12), the following equations can be reached:

$$Gf = KPA \times Gfo \quad (13)$$

-continued $$KPA = \frac{1 - (1/\epsilon)(PA/PB)^{1/\kappa}}{1 - (1/\epsilon)(PAo/PB)^{1/\kappa}} \quad (14)$$

where Pa designates actual atmospheric pressure (absolute pressure), PAo standard atmospheric pressure, and KPA an atmospheric pressure-dependent correction coefficient, hereinlater referred to, respectively.

As is learned from the above, the value of the correction coefficient KPA can be determined as a function of atmospheric pressure PA and intake pipe absolute pressure PB. According to the equation (14), the coefficient KPA has a value larger than 1 when the actual atmospheric pressure PA is smaller than the standard atmospheric pressure PAo. This means that the mixture becomes leaner when the atmospheric pressure drops below the standard value, at a high altitude, etc., unless atmospheric pressure-dependent correction of the air/fuel ratio is effected.

Embodiments of the invention for atmospheric pressure-dependent air/fuel ratio correction by means of the correction coefficient KPA will now be described with reference to FIGS. 3 through 11.

Figure 3:
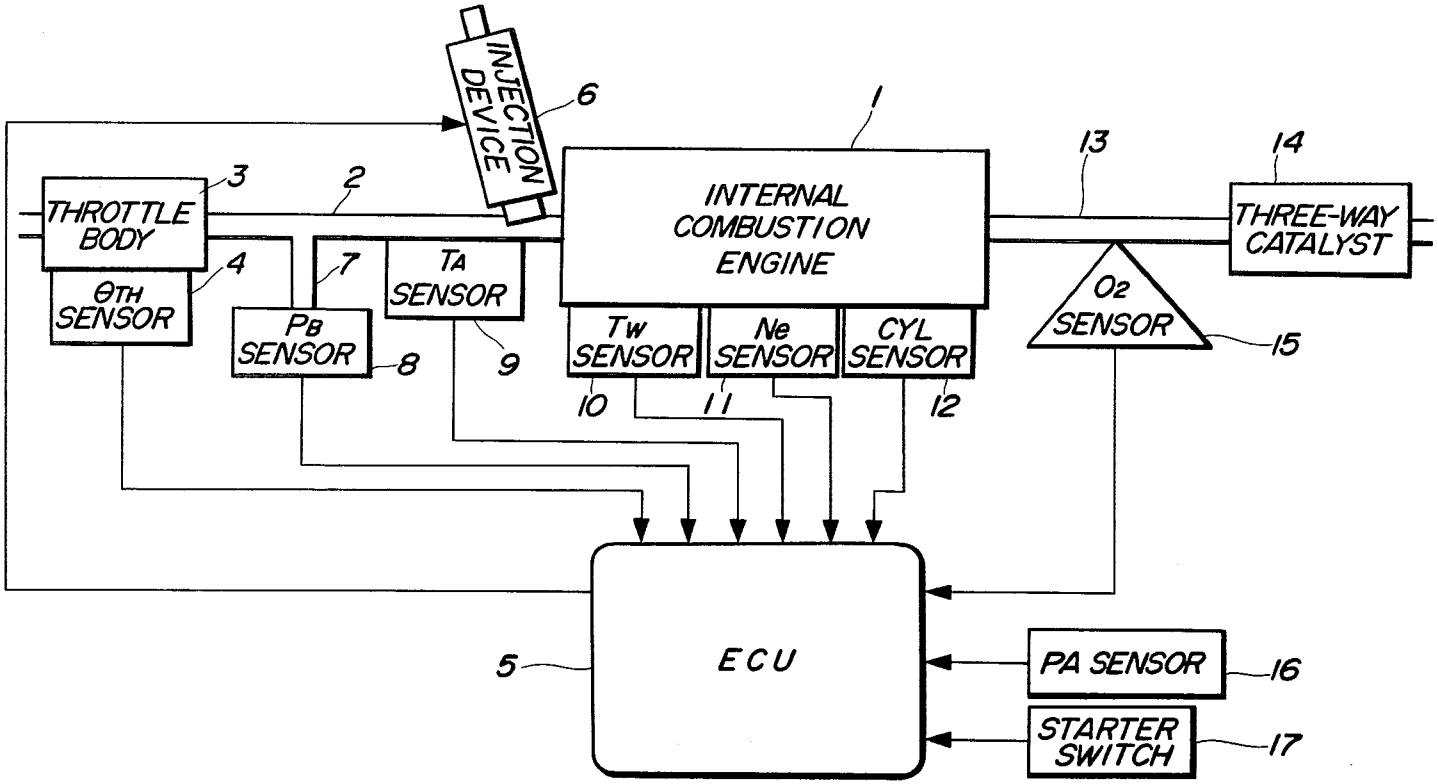
FIG. 3 is a block diagram illustrating the whole arrangement of a fuel supply control system to which the present invention is applicable.

Referring first to FIG. 3, there is illustrated the whole arrangement of a fuel injection control system for internal combustion engines, to which the present invention is applied. Reference numeral 1 designates an internal combustion engine which may be a four-cylinder type, for instance. This engine 1 has main combustion chambers which may be four in number and sub combustion chambers communicating with the main combustion chambers, none of which is shown. An intake pipe 2 is connected to the engine 1, which comprises a main intake pipe communicating with each main combustion chamber, and a sub intake pipe with each sub combustion chamber, respectively, neither of which is shown. Arranged across the intake pipe 2 is a throttle body 3 which accommodates a main throttle valve and a sub throttle valve mounted in the main intake pipe and the sub intake pipe, respectively, for synchronous operation. Neither of the two throttle valves is shown. A throttle valve opening sensor 4 is connected to the main throttle valve for detecting its valve opening and converting same into an electrical signal which is supplied to an electronic control unit (hereinafter called "ECU") 5.

A fuel injection device 6 is arranged in the intake pipe 2 at a location between the engine 1 and the throttle body 3, which comprises main injectors and a subinjector, all formed by electromagnetically operated fuel injection valves, none of which is shown. The main injectors correspond in number to the engine cylinders and are each arranged in the main intake pipe at a location slightly upstream of an intake valve, not shown, of a corresponding engine cylinder, while the subinjector, which is single in number, is arranged in the sub intake pipe at a location slightly downstream of the sub throttle valve, for supplying fuel to all the engine cylinders. The fuel injection device 6 is connected to a fuel pump, not shown. The main injectors and the subinjector are electrically connected to the ECU 5 in a manner having their valve opening periods or fuel injection quantities controlled by driving signals supplied from the ECU 5.

On the other hand, an absolute pressure sensor 8 communicates through a conduit 7 with the interior of the main intake pipe at a location immediately downstream of the main throttle valve of the throttle body 3. The absolute pressure sensor 8 is adapted to detect absolute pressure in the intake pipe 2 and apply an electrical signal indicative of detected absolute pressure to the ECU 5. An intake air temperature sensor 9 is arranged in the intake pipe 2 at a location downstream of the absolute pressure sensor 8 and also electrically connected to the ECU 5 for supplying thereto an electrical signal indicative of detected intake air temperature.

An engine temperature sensor 10, which may be formed of a thermistor or the like, is mounted on the main body of the engine 1 in a manner embedded in the peripheral wall of an engine cylinder having its interior filled with cooling water, an electrical output signal of which is supplied to the ECU 5.

An engine rpm sensor (hereinafter called "Ne sensor") 11 and a cylinder-discriminating sensor 12 are arranged in facing relation to a camshaft, not shown, of the engine 1 or a crankshaft of same, not shown. The former 11 is adapted to generate one pulse at a particular crank angle each time the engine crankshaft rotates through 180 degrees, i.e., a pulse of the top-dead-center position (TDC) signal, while the latter is adapted to generate one pulse at a particular crank angle of a particular engine cylinder. The above pulses generated by the sensors 11, 12 are supplied to the ECU 5.

A three-way catalyst 14 is arranged in an exhaust pipe 13 extending from the main body of the engine 1 for purifying ingredients HC, CO and NOx contained in the exhaust gases. An $O_2$ sensor 15 is inserted in the exhaust pipe 13 at a location upstream of the three-way catalyst 14 for detecting the concentration of oxygen in the exhaust gases and supplying an electrical signal indicative of a detected concentration value to the ECU 5.

Further connected to the ECU 5 are a sensor 16 for detecting atmospheric pressure and a starting switch 17 of the engine, respectively, for supplying an electrical signal indicative of detected atmospheric pressure and an electrical signal indicative of its own on and off positions to the ECU 5.

Figure 4:
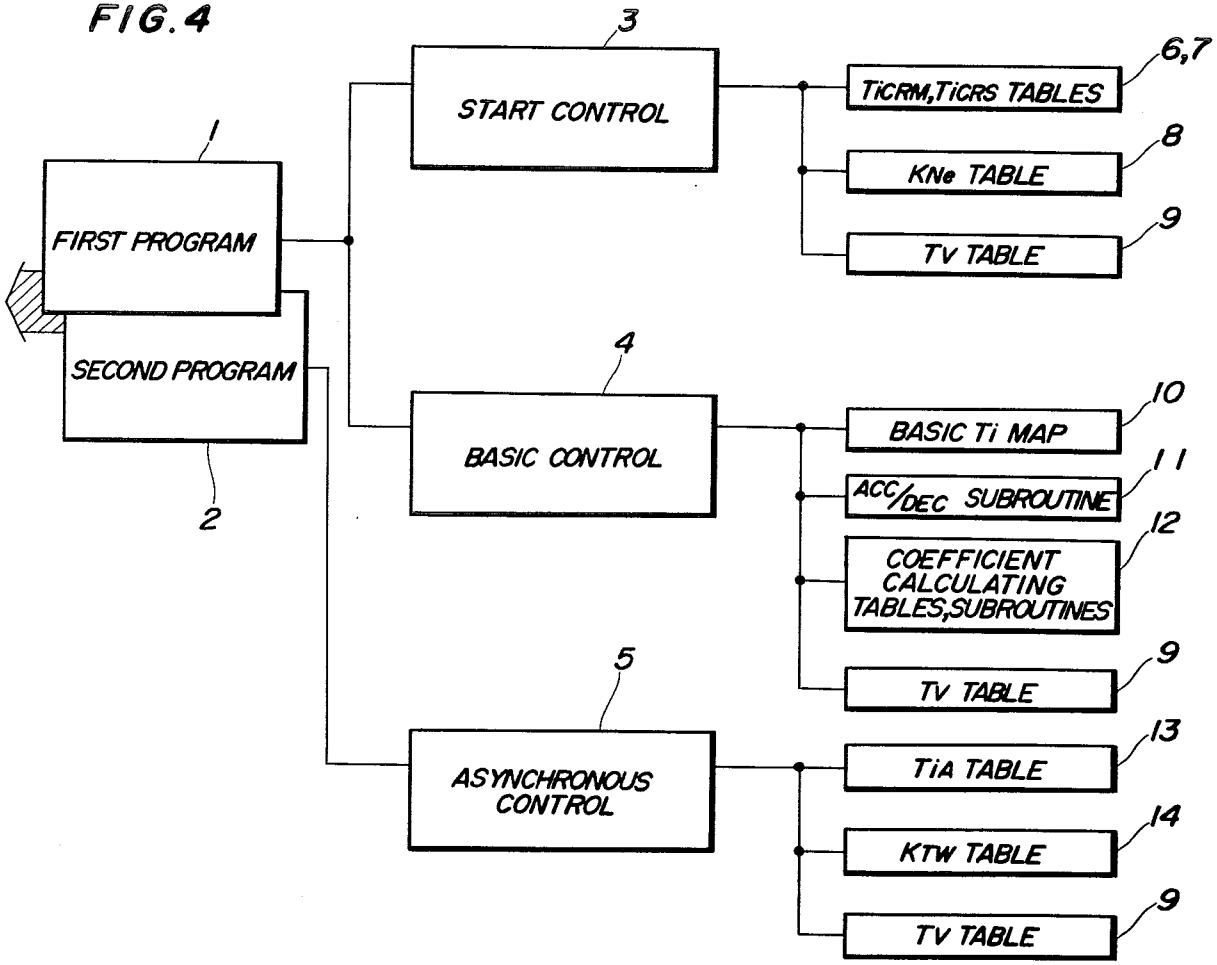
FIG. 4 is a block diagram illustrating a whole program for control of the valve opening periods TOUTM and TOUTS of the main injectors and the subinjector, which is incorporated in the electronic control unit (ECU) in FIG. 1.

FIG. 4 shows a block diagram showing the whole program for air/fuel ratio control, i.e., control of the valve opening periods TOUTM and TOUTS of the main injectors and the subinjector, which is executed by the ECU 5. The program comprises a first program 1 and a second program 2. The first program 1 is used for fuel quantity control in synchronism with the TDC signal, hereinafter merely called "synchronous control" unless otherwise specified, and comprises a start control subroutine 3 and a basic control subroutine 4, while the second program 2 comprises an asynchronous control subroutine 5 which is carried out in asynchronism with or independently of the TDC signal.

In the start control subroutine 3, the valve opening periods TOUTM and TOUTS are determined by the following basic equations:

$$TOUTM = TiCRM \times KNe + (TV + \Delta TV) \quad (15)$$

$$TOUTS = TiCRS \times KNe + TV \quad (16)$$

where TiCRM and TiCRS represent basic values of the valve opening periods for the main injectors and the subinjector, respectively, which are determined from a TiCRM table 6 and a TiCRS table 7, respectively, KNe represents a correction coefficient applicable at the start of the engine, which is variable as a function of engine rpm Ne and determined from a KNe table 8, and TV represents a constant for increasing and decreasing the valve opening period in response to changes in the output voltage of the battery 18, which is determined from a TV table 9. ΔTV is added to TV applicable to the main injectors as distinct from TV applicable to the subinjector, because the main injectors are structurally different from the subinjector and therefore have different operating characteristics.

The basic equations for determining the values of TOUTM and TOUTS applicable to the basic control subroutine 4 are as follows:

$$TOUTM = (TiM - TDEC) \times (KTA \times KTW \times KAFC \times KPA \times KAST \times KWOT \times KO_2 \times KLS) + TACC \times (KTA \times KTWT \times KAFC) + (TV + \Delta TV) \quad (17)$$

$$TOUTS = (TiS - TDEC) \times (KTA \times KTW \times KAST \times KPA) + TV \quad (18)$$

where TiM and TiS represent basic values of the valve opening periods for the main injectors and the subinjector, respectively, and are determined from a basic Ti map 10, and TDEC and TACC represent constants applicable, respectively, at engine decceleration and at engine acceleration and are determined by acceleration and decceleration subroutines 11. The coefficients KTA, KTW, etc. are determined by their respective tables and/or subroutines 12. KTA is an intake air temperature-dependent correction coefficient and is determined from a table as a function of actual intake air temperature, KTW a fuel increasing coefficient which is determined from a table as a function of actual engine cooling water temperature TW, KAFC a fuel increasing coefficient applicable after fuel cut operation and determined by a subroutine, KPA an atmospheric pressure-dependent correction coefficient determined from a table as a function of actual atmospheric pressure, and KAST a fuel increasing coefficient applicable after the start of the engine and determined by a subroutine. KWOT is a coefficient for enriching the air/fuel mixture, which is applicable at wide-open-throttle and has a constant value, $KO_2$ an "$O_2$ feedback control" correction coefficient determined by a subroutine as a function of actual oxygen concentration in the exhaust gases, and KLS a mixture-leaning coefficient applicable at "lean stoich." operation and having a constant value. The term "stoich." is an abbreviation of a word "stoichiometric" and means a stoichiometric or theoretical air/fuel ratio of the mixture. TACC is a fuel increasing constant applicable at engine acceleration and determined by a subroutine and from a table.

On the other hand, the valve opening period TMA for the main injectors which is applicable in asynchronism with the TDC signal is determined by the following equation:

$$TMA = TiA \times KTWT \times KAST + (TV + \Delta TV) \quad (19)$$

where TiA represents a TDC signal-asynchronous fuel increasing basic value applicable at engine acceleration and in asynchronism with the TDC signal. This TiA value is determined from a TiA table 13. KTWT is defined as a fuel increasing coefficient applicable at and after TDC signal-synchronous acceleration control as well as at TDC signal-asynchronous acceleration control, and is calculated from a value of the aforementioned water temperature-dependent fuel increasing coefficient KTW obtained from the table 14.

Figure 5:
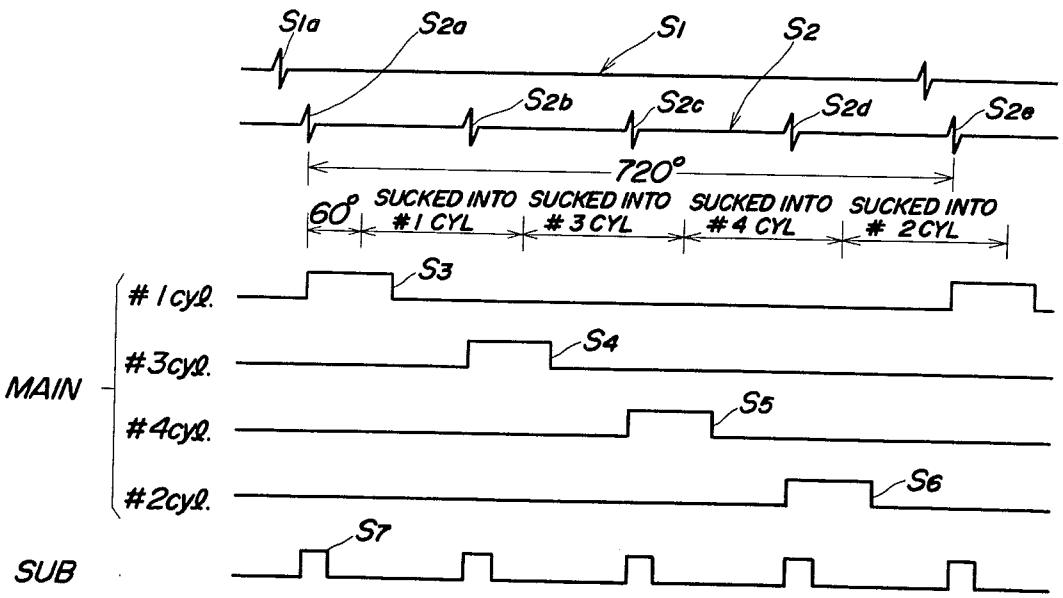
FIG. 5 is a timing chart showing the relationship between a cylinder-discriminating signal and a TDC signal inputted to the ECU, and driving signals for the main injectors and the subinjector, outputted from the ECU.

FIG. 5 is a timing chart showing the relationship between the cylinder-discriminating signal and the TDC signal, both inputted to the ECU 5, and the driving signals outputted from the ECU 5 for driving the main injectors and the subinjector. The cylinder-discriminating signal $S_1$ is inputted to the ECU 5 in the form of a pulse $S_1a$ each time the engine crankshaft rotates through 720 degrees. Pulses $S_2a$–$S_2e$ forming the TDC signal $S_2$ are each inputted to the ECU 5 each time the engine crankshaft rotates through 180 degrees. The relationship in timing between the two signals $S_1$, $S_2$ determines the output timing of driving signals $S_3$–$S_6$ for driving the main injectors of the four engine cylinders. More specifically, the driving signal $S_3$ is outputted for driving the main injector of the first engine cylinder, concurrently with the first TDC signal pulse $S_2a$, the driving signal $S_4$ for the third engine cylinder concurrently with the second TDC signal pulse $S_2b$, the driving signal $S_5$ for the fourth cylinder concurrently with the third pulse $S_2c$, and the driving signal $S_6$ for the second cylinder concurrently with the fourth pulse $S_2d$, respectively. The subinjector driving signal $S_7$ is generated in the form of a pulse upon application of each pulse of the TDC signal to the ECU 5, that is, each time the crankshaft rotates through 180 degrees. It is so arranged that the pulses $S_2a$, $S_2b$, etc. of the TDC signal are each generated earlier by 60 degrees than the time when the piston in an associated engine cylinder reaches its top dead center, so as to compensate for arithmetic operation lag in the ECU 5, and a time lag between the formation of a mixture and the suction of the mixture into the engine cylinder, which depends upon the opening action of the intake pipe before the piston reaches its top dead center and the operation of the associated injector.

Referring next to FIG. 6, there is shown a flow chart of the aforementioned first program 1 for control of the valve opening period in synchronism with the TDC signal in the ECU 5. The whole program comprises an input signal processing block I, a basic control block II and a start block III. First in the input processing block I, when the ignition switch of the engine is turned on, a CPU in the ECU 5 is initialized at the step 1 and the TDC signal is inputted to the ECU 5 as the engine starts at the step 2. Then, all basic analog values are inputted to the ECU 5, which include detected values of atmospheric pressure PA, absolute pressure PB, engine cooling water temperature TW, atmospheric air temperature TA, throttle value opening θth, battery voltage V, output voltage value V of the $O_2$ sensor and on-off state of the starting switch 17, some necessary ones of which are then stored therein (step 3). Further, the period between a pulse of the TDC signal and the next pulse of same is counted to calculate actual engine rpm Ne on the basis of the counted value, and the calculated value is stored in the ECU 5 (step 4). The program then proceeds to the basic control block II. In this block, a determination is made, using the calculated Ne value, as to whether or not the engine rpm is smaller than the cranking rpm (starting rpm) at the step 5. If the answer is affirmative, the program proceeds to the start control subroutine III. In this block, values of TiCRM and TiCRS are selected from a TiCRM table and a TiCRS table, respectively, on the basis of the detected value of engine cooling water temperature TW (step 6). Also, the value of Ne-dependent correction coefficient KNe is determined by using the KNe table (step 7). Further, the value of battery voltage-dependent correction constant TV is determined by using the TV table (step 8). These determined values are applied to the aforementioned equations (15), (16) to calculate the values of TOUTM and TOUTS (step 9).

If the answer to the question of the above step 5 is no, it is determined whether or not the engine is in a condition for carrying out fuel cut, at the step 10. If the answer is yes, the values of TOUTM and TOUTS are both set to zero, at the step 11.

On the other hand, if the answer to the question of the step 10 is negative, calculations are carried out of values of correction coefficients KTA, KTW, KAFC, KPA, KAST, KWOT, $KO_2$, KLS, KTWT, etc. and values of correction constants TDEC, TACC, TV and ΔTV, by means of the respective calculation subroutines and tables, at the step 12.

Then, basic valve opening period values TiM and TiS are selected from respective maps of the TiM value and the TiS value, which correspond to data of actual engine rpm Ne and actual absolute pressure PB and/or like parameters, at the step 13.

Then, calculations are carried out of the values TOUTM and TOUTS on the basis of the values of correction coefficients, correction constants and basic valve opening periods determined at the steps 12 and 13, as described above, using the aforementioned equations (17), (18) (step 14). The main injectors and the subinjector are actuated with valve opening periods corresponding to the values of TOUTM and TOUTS obtained by the aforementioned steps 9, 11 and 14 (step 15).

As previously stated, in addition to the above-described control of the valve opening periods of the main injectors and the subinjector in synchronism with the TDC signal, asynchronous control of the valve opening periods of the main injectors is carried out in a manner asynchronous with the TDC signal but synchronous with a certain pulse signal having a constant pulse repetition period, detailed description of which is omitted here.

Figure 7:
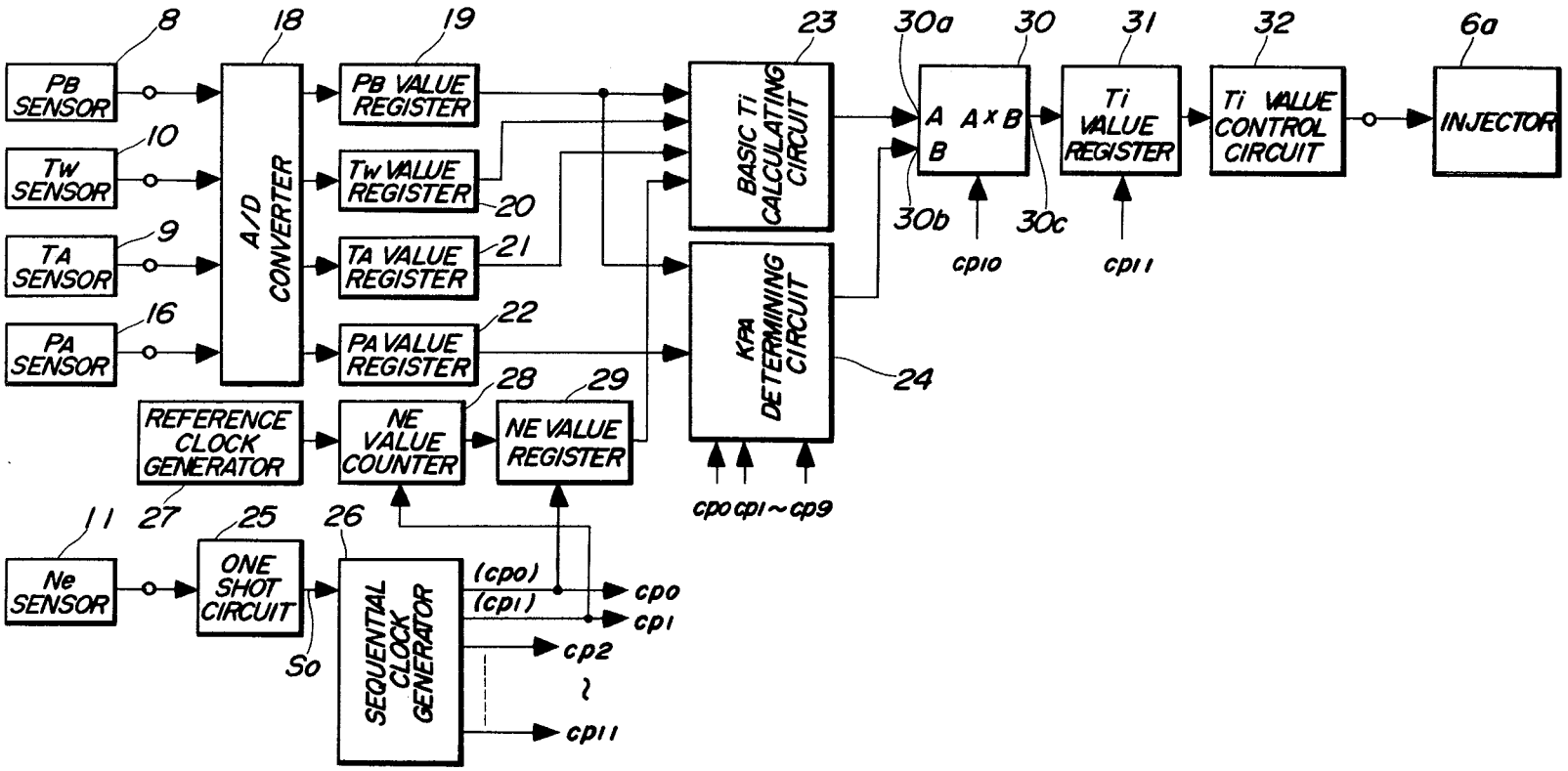
FIG. 7 is a block diagram illustrating the internal arrangement of the ECU, including a circuit for determining the value of an atmospheric pressure-dependent correction coefficient KPA.
Figure 8:
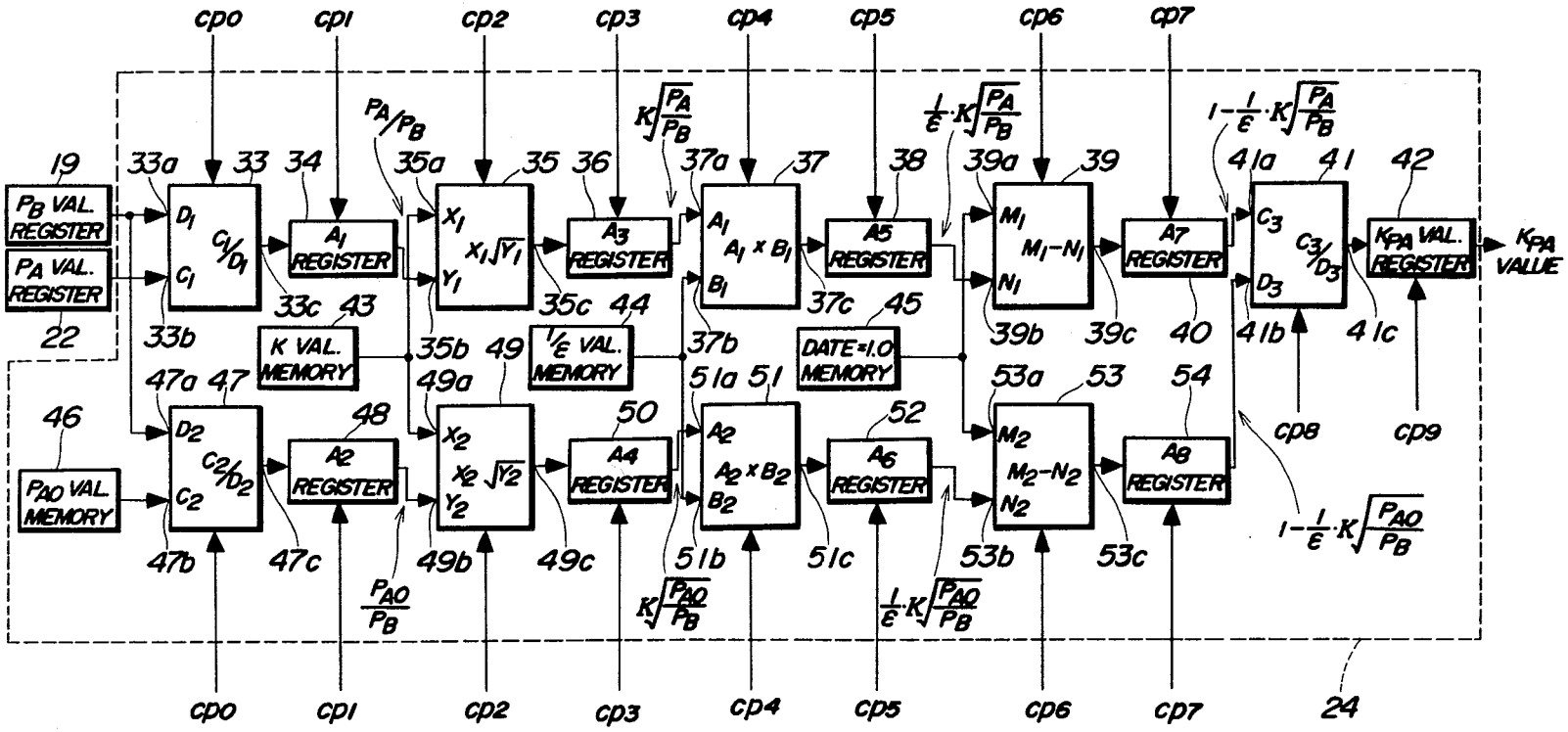
FIG. 8 is a block diagram illustrating in detail the coefficient KPA determining circuit in FIG. 7.
Figure 9:
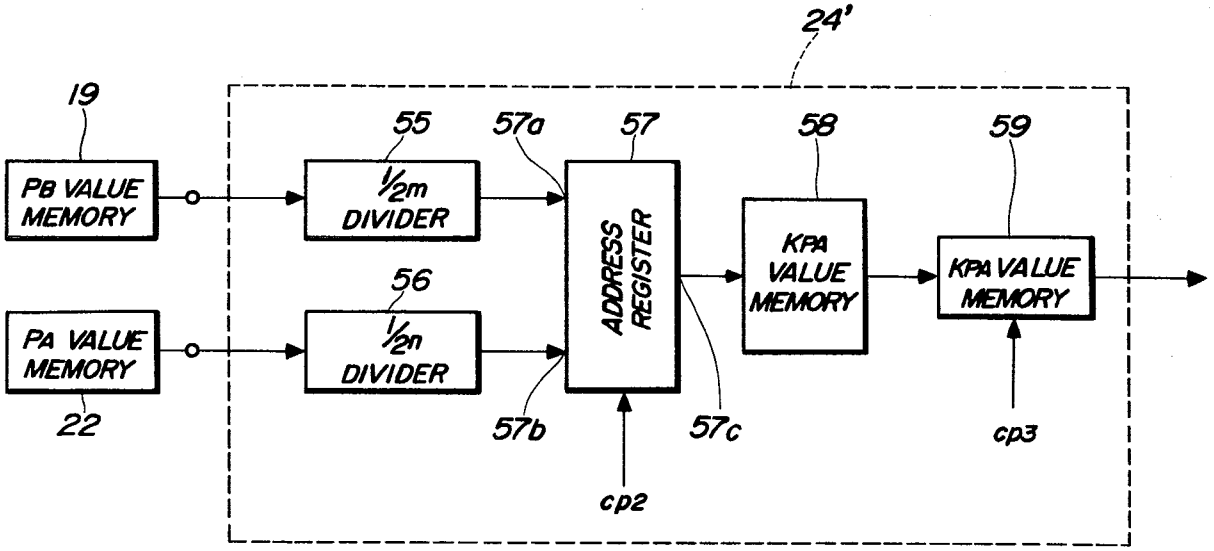
FIG. 9 is a block diagram illustrating another embodiment of the correction coefficient KPA determining circuit, which can be used in place of the circuit of FIG. 8.

FIGS. 7 through 9 illustrate the internal construction of the ECU 5 by way of example, including means for determining the air/fuel ratio correction coefficient KPA, referred to above. Referring first to FIG. 7, there is illustrated a whole circuit arrangement provided in the ECU 5, including a circuit for arithmetically calculating the value of the correction coefficient KPA. The intake pipe absolute pressure PB sensor 8, the engine cooling water temperature TW sensor 10, the intake-air temperature TA sensor 9, and the atmospheric pressure PA sensor 16, all appearing in FIG. 1, are connected, respectively, to a PB value register 19, a TW value register 20, a TA value register 21, and a PA value register 22, by way of a group of A/D converters 18. The PB value register 19 has its output connected to a basic Ti value calculating circuit 23 and also to a KPA value determining circuit 24. The TW value register 20 and the TA value register 21 have their respective outputs connected to the basic Ti value calculating circuit 23. The PA value register 22 has its output connected to the KPA value determining circuit 24. The engine rpm Ne sensor 11 is connected to a sequential clock generator 26, by way of a one shot circuit 25, which generator 26 in turn has several output terminals connected to respective ones of an NE value counter 28, an NE value register 29, the above KPA value calculating circuit 24, a multiplier 30, and a Ti value register 31. The NE value counter 28 is connected to a reference clock generator 27 to be supplied with clock pulses therefrom. The clock generator 27, the NE value counter 28, and the NE value register 29 are serially connected in the mentioned order, the NE value register 29 being connected at its output to the basic Ti value calculating circuit 23. The basic Ti value calculating circuit 23 has its output connected to the multiplier 30 at its one input terminal 30*a*, and the KPA value determining circuit 24 to the same circuit 30 at its other input terminal 30*b*, respectively. The multiplier 30 has its output terminal 30*c* connected to a Ti value control circuit 32 through the aforementioned Ti value register 31, which circuit 32 in turn has its output connected to the main injectors or subinjector 6*a* of the fuel injection device 6 in FIG. 3.

Figures 10, 11:
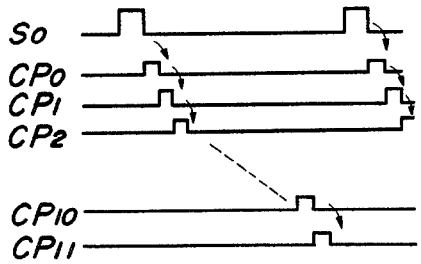
FIG. 10 is a view showing an atmospheric pressure-intake pipe absolute pressure map for determining the value of the correction coefficient KPA.
FIG. 11 is a timing chart showing the relationship between a pulse signal So inputted to the sequential clock generator in FIG. 7 and clock pulses generated therefrom.

An output or TDC signal of the engine rpm Ne sensor 11 is supplied to the one shot circuit 25 which forms a shaping circuit in cooperation with its adjacent sequential clock generator 26. Upon application of each pulse of the TDC signal to the one shot circuit 25, it generates an output pulse So and applies same to the sequential clock generator 26 to cause it to generate clock pulses CP0–CP11 in a sequential manner. FIG. 11 shows the manner in which the clock pulses CP0–CP11 are sequentially generated each time a pulse So is applied to the circuit 26. The clock pulse CP0 is applied to the NE value register 29 to cause same to store an immediately preceding count outputted from the NE value counter 28 which permanently counts reference clock pulses generated by the reference clock generator 27. Then, the clock pulse CP1 is applied to the NE value counter 28 to reset the immediately preceding count in the counter 28 to zero. Therefore, the engine rpm Ne is measured in the form of the number of reference clock pulses counted between two adjacent pulses of the TDC signal. The counted reference clock pulse number or measured engine rpm NE is loaded into the above NE value register 29. On the other hand, the clock pulses CP0–CP9 are supplied to the KPA value determining circuit 24, the clock pulse CP10 to the multiplier 30, and the last clock pulse CP11 to the Ti value register 31, respectively.

In a manner parallel with the above operation, output signals of the intake pipe absolute pressure PB sensor 8, the engine cooling water temperature TW sensor 10, the intake-air temperature TA sensor 9, and the atmospheric pressure PA sensor 16 are supplied to the A/D converter group 18 to be converted into respective corresponding digital signals which are in turn loaded into the PB value register 19, the TW value register 20, the TA value register 21, and the PA value register 22, respectively. These values stored in the registers are then supplied to the basic Ti value calculating circuit 23, which in turn performs arithmetic calculation of the basic valve opening Ti (TOUTM or TOUTS) for the fuel injection valve(s) 6*a* in accordance with the manner previously described with reference to FIGS. 4 through 6, on the basis of the input data PB, TW, TA and NE supplied from the registers 19, 20, 21 and 29. The calculated Ti value is supplied to the input terminal 30*a* of the multiplier 30 as an input A.

The KPA value determining circuit 24 determines the value of the atmospheric pressure-dependent correction coefficient KPA by arithmetic calculation, for instance, in a manner based upon the aforementioned equation (14), on the basis of input data PB and PA supplied from the PB value register 19 and the PA value register 22. A manner of calculation by the circuit 24 will be hereinlater described in detail with reference to FIG. 8. The resultant determined value of correction coefficient KPA is supplied to the other input terminal 30*b* of the multiplier 30 as an input B.

In the multiplier 30, multiplication of the value of the input A or the basic Ti value by the value of the input B or the correction coefficient KPA is carried out in synchronism with inputting of each clock pulse CP10 thereto from the sequential clock generator 26. The resultant calculated value or Ti value compensated for atmospheric pressure PA and intake pipe absolute pressure PB is outputted from the multiplier 30 through its output terminal 30*c* and loaded into the Ti value register 31. The Ti value register 31 stores the compensated Ti value upon application of each clock pulse CP11 thereto from the sequential generator 26, and applies same to the Ti value control circuit 32. The circuit 32 in turn operates upon the input Ti value data to supply a driving signal to each fuel injection valve 6*a* to open same for a valve opening period corresponding to the input Ti value.

FIG. 8 illustrates details of the internal construction of the KPA value determining circuit 24 in FIG. 7, where arithmetic calculation of the correction coefficient KPA is carried out in a manner based upon the aforementioned equation (14). The PB value register 19 in FIG. 7 has its output connected to a divider 33 at its one input terminal 33*a*, as well as to another divider 47 at its one input terminal 47*a*. The PA value register 22 in FIG. 7 has its output connected to the divider 33 at its other input terminal 33*b*. The divider 33 has its output terminal 33*c* connected to a root calculating circuit 35 at its one input terminal 35*b* by way of an A1 register 34, which in turn has its output terminal 35*c* connected to a multiplier 37 at its one input terminal 37*a*, by way of an A3 register 36. The multiplier 37 has its output terminal 37*c* connected to a subtracter 39 at its one input terminal 39*b* by way of an A5 register 38, which in turn has its output terminal 39*c* connected to a divider 41 at its one input terminal 41*a*, through an A7 register 40. The divider 41 has its output terminal 41*c* connected to the input terminal 30*b* of the multiplier 30 in FIG. 7 by way of a KPA value register 42. The aforementioned divider 47 has its output terminal 47*c* connected to a root calculating circuit 49 at its one input terminal 49*b* through an A2 register 48, which in turn has its output terminal 49*c* connected to a multiplier 51 at its one input terminal 51*a* through an A4 register 50. The multiplier 51 has its output terminal 51*c* connected to a subtracter 53 at its one input terminal 53*b*, which has its output terminal 53*c* connected to the other input terminal 41*b* of the divider 41, through an A8 register 54. A PAo value memory 46 is connected to the other input terminal 47*b* of the divider 47. A K value memory 43 is connected to the other input terminals 35*a* and 49*a* of the root calculating circuits 35 and 49. A $1/\epsilon$ value memory 44 is connected to the other input terminals of the multipliers 37 and 51, and a 1.0 value memory 45 is connected to the other input terminals 39*a* and 53*a* of the subtracters 39 and 53.

The KPA value determining circuit 24 constructed above operates as follows: The divider 33 has its input terminal 33*a* supplied with PB value data from the PB value register 19 in FIG. 7 as an input D1, and its other input terminal 33*b* with PA value data from the PA value register 22 in FIG. 7 as an input C1, respectively. The divider 33 supplies a quotient of C1/D1 or PA/PB obtained by dividing the value of the input C1 by the value of the input D1, to the A1 register 34, upon application of each clock pulse CP0 to the circuit 33. The A1 register 34 in turn replaces its old stored value by the new value C1/D1 each time a clock pulse CP1 is applied thereto, and supplies its newly stored value to the input terminal 35*b* of the root calculating circuit 35, as an input Y1. The root calculating circuit 35 has its other input terminal 35*a* supplied with a value of ratio of specific heat $\kappa$ of air from the K value memory 43, as an input X. The root calculating circuit 35 calculates the X1th root of Y1, i.e. $\kappa\sqrt{PA/PB}$, upon application of each clock pulse CP2 thereto, and applies same to the A3 register 36 through its output terminal 35*c*. Upon application of each clock pulse CP3 to the A3 register 36, it replaces its old stored value by the new value of $\kappa\sqrt{PA/PB}$ and applies same to the input terminal 37*a* of the multiplier 37, as an input A1. The multiplier 37 has its other input terminal 37*a* supplied with a value of $1/\epsilon$ from the $1/\epsilon$ value memory 44, an input B1, so that multiplication of the input A1 by the input B1 is carried out upon application of each clock pulse CP4 to the multiplier 37. The resultant product A1×B1, i.e. $1/\epsilon\cdot\kappa\sqrt{PA/PB}$ is supplied to the A5 register 38, through its output terminal, 37*c*. Upon application of each clock pulse CP5 to the A5 register 38, it replaces its old stored value by the new value of the product A1×B1, and supplies same to the subtracter 39 at its input terminal 39*b*, as an input N1. The subtracter 39 has its other input terminal 39*a* supplied with a value of 1.0 from the 1.0 value memory 45, as an input M1, so that subtraction of N1 from M1 is calculated, upon application of each clock pulse CP6 to the subtracter 39. The resultant difference or $1-1/\epsilon\cdot\kappa\sqrt{PA/PB}$ is applied to the A7 register 40, through the output terminal 39*c* of the subtracter 39. The A7 register 40 has its old stored value replaced by the new value of the above difference M1-N1, upon application of each clock pulse CP7 thereto, and supplies same to the divider 41 at its input terminal 41*a*, as an input C3.

On the other hand, similar calculations to those described above are carried out also in the divider 47, the root calculating circuit 49, the multiplier 51, and the subtracter 53. For instance, at the divider 47, a quotient of PAo/PB is calculated on the basis of a standard atmospheric pressure value PAo supplied from the PAo value memory as an input C2, and an actual intake pipe absolute pressure value PB supplied from the PB value register 19, as an input D2. Further, a root value of $\kappa\sqrt{PAo/PB}$ is calculated at the root calculating circuit 49, a product of $1/\epsilon\cdot\kappa\sqrt{PAo/PB}$ at the multiplier 51, and a difference of $1-1/\epsilon\cdot\kappa\sqrt{PAo/PB}$ at the subtracter 53, respectively, in manners similar to those described above. Finally, the divider 41 has its input terminal 41*b* supplied with the resultant difference of $1-1/\epsilon\cdot\kappa\sqrt{PAo/PB}$, as an input D3. At the divider 41, division of the input C3 by the input D3 is carried out to obtain a quotient of C3/D3, that is, $$KPA = \frac{1 - 1/\epsilon(PA/PB)^{1/\kappa}}{1 - 1/\epsilon(PAo/PB)^{1/\kappa}}$$

The above quotient is outputted from the divider 41 through its output terminal 41*c* and applied to the KPA value register 42. The KPA value register 42 has its old stored value replaced by the new value of C3/D3 or KPA upon application of each clock pulse CP9 thereto, and applies its new stored value to the input terminal 30b of the multiplier 30 in FIG. 7.

FIG. 9 illustrates another embodiment of the KPA value determining circuit 24 in FIG. 7. According to this embodiment, a correction coefficient KPA value is read from a plurality of predetermined values which are previously determined by using the aforegiven equation (14) and stored, in accordance with detected values of atmospheric pressure PA and intake pipe absolute pressure PB. The PB value register 19 in FIG. 7 has its output connected to an address register 57 at its first input terminal 57a, by way of a $\frac{1}{2}^m$ divider 56. The PA value register 22 has its output connected to the same address register 57 at its second input terminal 57b by way of a $\frac{1}{2}^n$ divider 56. The address register 57 has its output terminal 57c connected to the input of a KPA value data memory 58 which in turn has its output connected to the input of a KPA value register 59. This KPA value register 59 has its output connected to the input terminal 30b of the multiplier 30 in FIG. 7.

FIG. 10 illustrates a map for determining the value of correction coefficient KPA in accordance with atmospheric pressure PA and intake pipe absolute pressure PB. The KPA values in the map are previously calculated by the equation (14). Although in the FIG. 10 example, the PA value and the PB value are each comprised of eight predetermined values, they may each be comprised of another number of such predetermined values. When the actual value PA or PB lies between adjacent ones of the predetermined PA or PB values, the KPA value may be determined by means of an interpolation method, to avoid use of a large capacity memory.

A plurality of addresses are stored in the address register 57 in FIG. 9, which correspond to the predetermined values of atmospheric pressure PA and intake pipe absolute pressure PB in the map of FIG. 10, while predetermined values KPAij of correction coefficient KPA are stored in the KPA value data memory 58, which correspond to the above addresses in the register 57.

An output of the PB value register 19 in FIG. 7 is supplied to the $\frac{1}{2}^m$ divider 55 in FIG. 9 to be converted into a corresponding integral number, and then loaded into the address register 57 through its first input terminal 57a. On the other hand, an output of the PA value register 22 is supplied to the $\frac{1}{2}^n$ divider 26 to be converted into a corresponding integral number and loaded into the address register 57 through its second input terminal 57b. An address corresponding to the loaded values PA and PB is selectively read from the register 57 upon application of each clock pulse CP2 thereto, and supplied to the KPA value data memory 58. At the KPA value memory 58, a value of the correction coefficient KPA is selectively read, which corresponds to the input address, and then loaded into the KPA value register 59. The latter replaces its old stored value by the new KPA value inputted thereto, upon application of each clock pulse CP3 thereto, and the new KPA value is supplied to the input terminal 30b of the multiplier 30 in FIG. 7.

What is claimed is:

1. A method for correcting the air/fuel ratio of an air/fuel mixture being supplied to an internal combustion engine having an intake pipe, and a throttle valve arranged in said intake pipe, comprising: detecting a value of at least one parameter indicative of the operating condition of said engine; determining a value of the air/fuel ratio of said air/fuel mixture in accordance with the detected value of said at least one parameter; detecting a value of absolute pressure of the atmosphere encompassing said engine; detecting a value of absolute pressure in said intake pipe at a location downstream of said throttle valve; determining a value of a coefficient for correction of said determined value of the air/fuel ratio, as a function of the detected values of said atmospheric absolute pressure and said intake pipe absolute pressure; and correcting the determined value of the air/fuel ratio by an amount corresponding to the determined value of said correction coefficient.

2. The method as claimed in claim 1, wherein the value of said correction coefficient is determined by the following equation:

$$KPA = \frac{1 - 1/\epsilon(PA/PB)^{1/\kappa}}{1 - 1/\epsilon(PAo/PB)^{1/\kappa}}$$

where $\epsilon$ represents the compression ratio of said engine, PA the atmospheric absolute pressure, PAo the standard atmospheric absolute pressure, PB the intake pipe absolute pressure, and $\kappa$ the ratio of specific heat of air, respectively.

3. The method as claimed in claim 1 or claim 2, wherein said at least one parameter comprises engine rpm and absolute pressure in said intake pipe at a location downstream of said throttle valve.

4. In a fuel supply control system adapted for controlling the air/fuel ratio of an air/fuel mixture being supplied to an internal combustion engine, said engine having an intake pipe, a throttle valve arranged in said intake pipe, and at least one electromagnetically controlled fuel injection valve arranged for injecting fuel into said intake pipe at a location downstream of said throttle valve, said fuel injection valve having a valve opening period thereof adapted to determine a fuel injection quantity thereof, wherein the air/fuel ratio of said air/fuel mixture is controlled by varying the valve opening period of said fuel injection valve, an air/fuel ratio correcting device comprising: means for detecting a value of at least one parameter indicative of the operating condition of said engine; means for determining a value of the valve opening period of said fuel injection valve in accordance with the detected value of said at least one parameter; a first pressure sensor for detecting a value of absolute pressure of the atmosphere encompassing said engine; a second pressure sensor for detecting a value of absolute pressure in said intake pipe at a location downstream of said throttle valve; means for arithmetically calculating a value of a coefficient for correction of the valve opening period of said fuel injection valve as a function of output values of said first and second pressure sensors; and means for correcting the determined valve opening period of said fuel injection valve by an amount corresponding to the calculated value of said correction coefficient.

5. The air/fuel ratio correcting device as claimed in claim 4, wherein said arithmetically calculating means is adapted to arithmetically calculate the value of said correction coefficient by the following equation:

$$KPA = \frac{1 - 1/\epsilon(PA/PB)^{1/\kappa}}{1 - 1/\epsilon(PAo/PB)^{1/\kappa}}$$

where $\epsilon$ represents the compression ratio of said engine, PA the atmospheric absolute pressure, PAo the standard atmospheric absolute pressure, PB the intake pipe absolute pressure, and $\kappa$ the ratio of specific heat of air, respectively.

6. In a fuel supply control system adapted for controlling the air/fuel ratio of an air/fuel mixture being supplied to an internal combustion engine, said engine having an intake pipe, a throttle valve arranged in said intake pipe, and at least one electromagnetically controlled fuel injection valve arranged for injecting fuel into said intake pipe at a location downstream of said throttle valve, said fuel injection valve having a valve opening period thereof adapted to determine a fuel injection quantity thereof, wherein the air/fuel ratio of said air/fuel mixture is controlled by varying the valve opening period of said fuel injection valve, an air/fuel ratio correcting device comprising: means for detecting a value of at least one parameter indicative of the operating condition of said engine; means for determining a value of the valve opening period of said fuel injection valve in accordance with the detected value of said at least one parameter; a first pressure sensor for detecting a value of absolute pressure of the atmosphere encompassing said engine; a second pressure sensor for detecting a value of absolute pressure in said intake pipe at a location downstream of said throttle valve; means storing a plurality of predetermined values of a coefficient for correction of the valve opening period of said fuel injection valve, said predetermined values being functions of said atmospheric absolute pressure and said intake pipe absolute pressure; means for selectively reading from said storage means a corresponding one of said predetermined correction coefficient values to output values of said first and second pressure sensors; and means for correcting the determined value of the valve opening period of said fuel injection valve by an amount corresponding to the read value of said correction coefficient.

7. The air/fuel ratio correcting device as claimed in claim 6, wherein the value of said correction coefficient is determined by the following equation:

$$KPA = \frac{1 - 1/\epsilon(PA/PB)^{1/\kappa}}{1 - 1/\epsilon(PAo/PB)^{1/\kappa}}$$

where $\epsilon$ represents the compression ratio of said engine, PA the atmospheric absolute pressure, PAo the standard atmospheric absolute pressure, PB the intake pipe absolute pressure, and $\kappa$ the ratio of specific heat of air, respectively.

* * * * *